United States Patent [19]

Russell

[11] 4,401,045

[45] Aug. 30, 1983

[54] THREAD TRIMMING MECHANISM FOR SEWING MACHINES

[75] Inventor: Angus R. T. Russell, Englishtown, N.J.

[73] Assignee: The Singer Company, Stamford, Conn.

[21] Appl. No.: 440,054

[22] Filed: Nov. 8, 1982

[51] Int. Cl.[3] ..... D05B 65/00

[52] U.S. Cl. ..... 112/286; 112/292; 112/297; 112/300

[58] Field of Search ..... 112/286, 288, 294, 291, 112/292, 297, 300

[56] References Cited

U.S. PATENT DOCUMENTS

| | | | |
|---|---|---|---|
| 2,707,927 | 5/1955 | Artzt et al. | 112/286 |
| 3,184,622 | 5/1965 | Levine | 310/30 |
| 3,211,117 | 10/1965 | Speichermann et al. | 112/292 |
| 3,386,402 | 6/1968 | Ross | 112/292 |
| 3,400,677 | 9/1968 | Bowers et al. | 112/300 X |
| 3,867,892 | 2/1975 | Ciecior et al. | 112/286 |

*Primary Examiner*—H. Hampton Hunter

*Attorney, Agent, or Firm*—Robert E. Smith; Edward L. Bell

[57] ABSTRACT

A solenoid operated sewing machine thread trimmer with a compression spring influenced armature, a spring offsetting permanent magnet, and solenoid coil means with energizing circuits alternately offsetting the permanent magnet freeing the compression spring to shift the armature in one direction or augmenting the permanent magnet to return the armature.

8 Claims, 5 Drawing Figures

THREAD TRIMMING MECHANISM FOR SEWING MACHINES

BACKGROUND OF THE INVENTION

This invention relates to thread trimming mechanisms, and more particularly, to an underbed thread trimming mechanism for sewing machines.

In the operation of an underbed thread trimming mechanism, two successive stages are required, each of which is critical in a different way. First, provision must be made for engaging or insuring that engagement will occur of the trimming mechanism with both the needle and looper threads of the sewing machine while these thrads extend beneath the work supporting bed of the machine; and second, a cutting action must be effected after the sewng threads have been sufficiently freed from the stitch forming instrumentalities as to make thread severance feasible. The first stage of underbed thread trimmer operation is usually the most critical insofar as timing is concerned since it requires motion of elements of the trimmer in close proximity to moving parts of the stitch forming instrumentalities. The second stage of underbed thread trimmer operation involves forces of a higher degree of magnitude incident to the drawing of thread under tension and the cooperative movement of the thread cutter elements.

To provide for one or both of these different stages of underbed thread trimmer operation, prior known mechanisms have utilized cams driven by the sewing machine. Such cam drives, however, are not only complex, costly, and not readily retrofittable on sewing machines, but they require a sewing machine drive motor capable of producing a higher torque. It is known to actuate an underbed thread trimmer by means of a double acting solenoid or two separate solenoids, both of which multiply the expense and complexity of the trimmer installation. Single acting solenoid actuated thread trimmers are also known in which the solenoid is energized to shift a thread engaging element into distended position in opposition to a spring which serves to return the element into thread cutting relation with a ledger blade. Relatively high magnitudes of force are necessary with this type of trimmer actuation with consequent increased expense.

SUMMARY OF THIS INVENTION

It is an object of this invention to provide an underbed thread trimmer mechanism which may be retrofit readily to existing sewing machines, and which is actuated by a cost effective, single acting solenoid by virtue of novel constructions and arrangements of the solenoid by virtue and novel arrangements for effecting a sequence of different energization modes for the solenoid so as to influence the required successively different stages of trimmer operation.

DESCRIPTION OF THE DRAWINGS

With the above and additional objects and advantages in view as will hereinafter appear, this invention will be described with reference to a preferred embodiment illustrated in the accompanying drawing in which.

DESCRIPTION OF THE INVENTION

Figure 1:
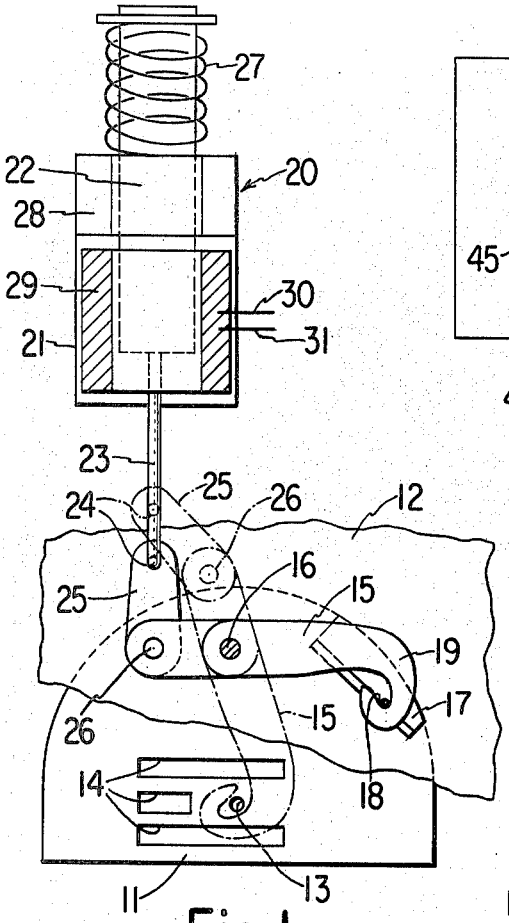
FIG. 1 is a bottom plan view of a fragment of a sewing machine bed showing a throat plate and illustrating the thread trimming mechanism of this invention with a preferred form of an actuating solenoid therefor.

Referring to FIG. 1, 11 represents the underside of the work supporting throat plate of a sewing machine which is carried on bed 12 of which a fragment is shown. As is conventional, the throat plate is formed with a needle accommodating aperture 13 and with feed dog slots 14. This invention is adaptable to any sewing machine having a thread carrying needle which delivers needle thread loops through the needle aperture for seizure and concatenation by any known form of loop taker beneath the throat plate. Moreover, the concatenation may involve introduction of a thread associated with the loop taker, i.e., a bobbin thread in the case of a lock stitch or a looper thread in the case of a chain stitch. Since this invention has general application, the specific stitch forming instrumentalities of a sewing machine are not illustrated in the accompanying drawing.

Shiftably supported beneath the bed 12 adjacent the throat plate 11 is a thread picker 15, which may be pivoted on a fulcrum pin 16. Also carried beneath the bed 12, preferably in a fixed position thereon, is a ledger blade 17 cooperative with a cutting edge 18, on a thread engaging finger 19 of the thread picker 15 to sever any threads which may be drawn across the ledger blade 17 by the thread engaging finger of the thread picker.

Indicated generally at 20 in FIG. 1, is an electric solenoid including a frame 21 which may be suported beneath the sewing machine bed in fixed predetermined relation to the throat plate 11. A ferromagnetic armature plunger 22 is slidably arranged in the solenoid frame and joined by a connecting rod 23 pivoted at 24 to a link 25, which in turn is pivoted at 26 to the thread picker 15.

The solid line position of the thread picker 15 in FIG. 1 is the retracted position thereof in effective thread trimming relation with the ledger blade 17. A compression spring 27 associated with the solenoid and acting between the armature plunger 22 and the solenoid frame biases the picker 15 toward an extended position illustrated in dotted lines in FIG. 1 suitable for engagement with sewing threads of the sewing machine.

The solenoid 20, however, includes a permanent magnet 28 having a magnetic flux generating capacity and position relative to the armature 22 chosen so as to neutralize the influence of the spring 27 on the armature.

The solenoid 20 also includes a wire coil 29 having leads 30, 31 which coil is arranged relative to the armature plunger so as to exert an influence shifting the armature relatively to the solenoid frame upon energization of the coil.

In the stable condition of the solenoid 20, with no energization of the coil 29, the thread picker 15 will remain in its final actuated position, i.e., at the start of each cycle it will occupy the retracted position as illustrated in solid lines in FIG. 1.

Two modes of actuation of the solenoid 20 are contemplated in this invention. First, by an application to the leads 30–31 of electrical energy of a low level of magnitude and a polarity chosen substantially to cancel the neutralizing effect of the permanent magnet 28 on the solenoid armature. The result of such first mode of actuation is to free the spring 27 for movement of the thread picker to the extended position illustrated in dotted lines in FIG. 1.

A second mode of solenoid actuation involves the application of the coil leads 30–31 of electrical energy of a higher magnitude and opposite polarity effective to shift the armature, and with it the thread picker 15, into the retracted position with a force high enough to draw out the engaged sewing threads and effect thread trimming with predictable certainty.

Figure 2:
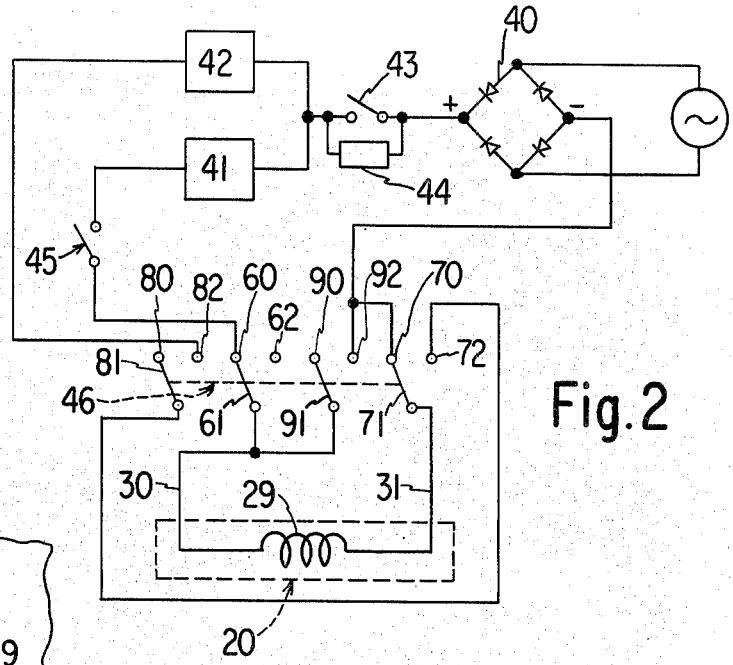
FIG. 2 is a circuit diagram illustrating an electrical arrangement for operating the preferred form of actuating solenoid illustrated in FIG. 1.
Figure 3:
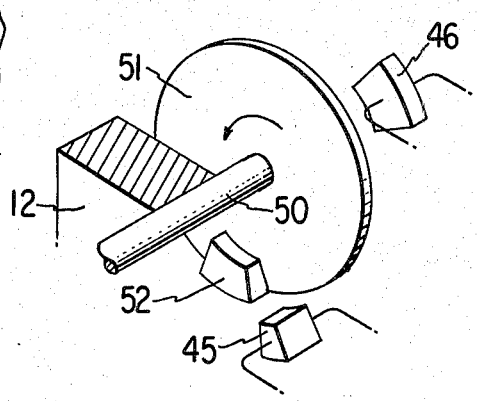
FIG. 3 is a perspective view of a fragment of the sewing machine including an operating shaft thereof and a timing device for controlling the thread trimming mechanism of this invention.

Referring to FIGS. 2 and 3, a circuit diagram and timing device are shown illustrating an arrangement for providing the sequence of successively different stages of trimmer actuation described above.

As shown in FIG. 1, a full wave diode bridge 40 is connected on its positive side to two voltage regulators 41 and 42 which, for example, may provide 8 and 24 volts, respectively. An operator influenced switch 43 may be provided between the diode bridge and the voltage regulators closure of which for instance, by heeling of a control treadle (not shown) serves to initiate the thread trimming sequence. As illustrated in FIG. 2, any conventional holding circuit 44 may be employed for maintaining the switch 43 closed until completion of a complete cycle of thread trimming operation.

Two switches 45 and 46 are employed connecting the voltage regulators 41 and 42 with the solenoid coil leads 30 and 31. Switch 45 is a normally open switch and switch 46 is a multipole, double throw switch having its normal position as shown in FIG. 2.

As shown in FIG. 3, a timing device is provided on the sewing machine 12 for operating the switches 45 and 36 in a predetermined sequence. Preferably, a shaft 50 in the sewing machine which rotates one revolution for each stitch forming cycle is provided with a disc 51 thereon carrying an actuator, for instance, a magnet 52. The switches 45 and 46 may be operated by Hall effect devices influenced by proximity to the magnet 52, or alternatively, reed type switches may be employed. The location of switch 45 is preferably arranged so that switch closure will be effected in a stitch forming cycle shortly after needle loop seizure by the sewing machine loop taker, i.e., while all of the thread associated with the stitch formation are being manipulated by the loop taker and the needle has exited the throat plate needle aperture 13.

The location of switch 46 is preferably arranged so that the switch is thrown out of its normal position at an appropriate angle of shaft 50 after loop seizure, usually slightly less than one half revolution beyond the position of switch 45 and corresponding to a shaft 50 position at which manipulation of the sewing threads by the loop taker has been completed or progressed as far as it is ever going to in the formation of the stitch which is being formed.

As shown in FIG. 2, the switch 45 is connected to the low voltage regulator 41 and to a normally closed pole 60 of multipole switch 46 to the contact 61 of which the solenoid coil lead 30 is connected. Solenoid coil lead 31 is connected to a contact 71 of the multipole switch 46 which in the normal position of switch 46 is closed to a pole 70 wired to the negative side of the rectifier 40.

During the time that the switch 45 is closed, therefore, low voltage, i.e., approximately 8 volts DC will be applied to the solenoid coil 29 with a predetermined polarity; the lead 30 being positive with respect to the lead 31. With respect to the armature 22 and the permanent magnet 28, the solenoid coil 29 is arranged such that when energized with low voltage in the polarity described above, the magnetic effect of the permanent magnet 28 will be substantially completely conunteracted and the spring 27 will be free of any magnetic influence on the armature and will thus act to draw the armature into the solenoid frame and shift the thread picker into its extended position, as illustrated in dotted lines in FIG. 1, for engagement with the sewing threads.

Preferably, the magnet 52 is formed and arranged to maintain the switch 45 closed until immediately prior to influence of the switch 46, thus allowing the spring 27 to maintain its influence holding the thread picker 15 in extended position as shown in dotted lines in FIG. 1

As the magnet 52 moves beyond switch 45 and adjacent to switch 46, switch 45 will reopen and the contacts 61, 71, 81 and 91 of switch 46 in ganged arrangement will be shifted from the normal position closed to poles 60, 70, 80 and 90, respectively, and instead into engagement with poles 62, 72, 82 and 92, respectively. A circuit will thus be established from the positive side of the rectifier 40 and the high voltage regulator 42 through pole 82, contact 81, pole 72 and contact 71 of the switch 46 to the solenoid lead 31. The negative side of the rectifier 40 will be connected to the solenoid lead 30 by way of the pole 92 and contact 91 of the switch 46. As a result, a high voltage, for instance 24 volts DC, will be applied to the solenoid coil 29 in a polarity which is reversed from that in which the low voltage energization was applied to the solenoid coil. As a result, when so energized, the solenoid coil 29 will augment the influence of the permanent magnet 28 on the solenoid armature 22 and together these magnetic influences will provide a high force reaction to the solenoid armature in opposition to that of the spring 27 so as to return the thread picker 15 to the solid line position shown in FIG. 1. The threads caught by the picker will be severed by the interaction of the cutting edge 18 and the ledger blade 17.

When the magnet 52 moves beyond the switch 46 and the switch contacts 61, 71, 81 and 91 revert to their normal position shown in FIG. 1, the permanent magnet 28 will again completely offset the influence of the spring 27 and the picker 15 will remain in retracted position, shown in solid lines in FIG. 1, and the thread trimming cycle of operation will have been completed.

Upon completion of trimming, the holding circuit 44 will release the switch 43 to its normally open position. The switch 43 and holding circuit 44 may be associated with any conventional needle positioning mechanism for arresting the sewing machine in a predetermined position of the stitch forming instrumentalities.

Figure 4:
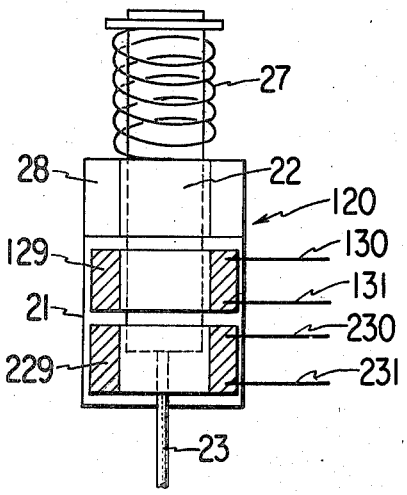
FIG. 4 is a plan view of a modified form of actuating solenoid for the thread trimming mechanism of this invention.
Figure 5:
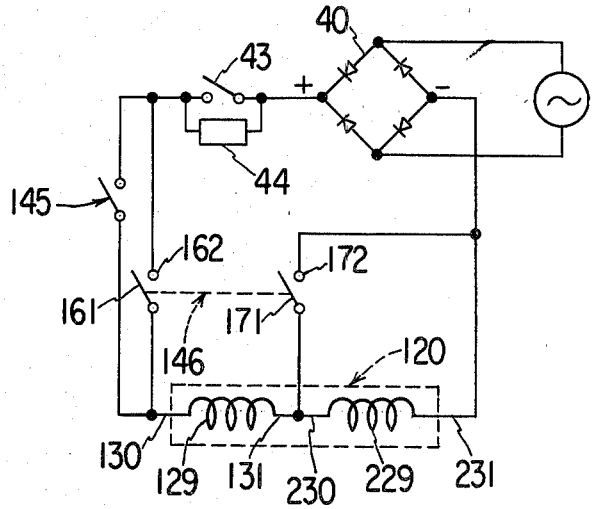
FIG. 5 is a circuit diagram illustrating an electrical arrangement for operating the actuating solenoid illustrated in FIG. 4.

Illustrated in FIGS. 4 and 5 is a modified form of construction embodying the features of this invention. This modified form of construction involves only a change of the solenoid coil arrangement together with a change in the circuitry for actuating the solenoid coils, and since all other aspects of the construction may be identical to those described above with reference to the form of construction illustrated in FIGS. 1 and 2, elements which are common thereto in the modified form shown in FIGS. 4 and 5 will be indicated by the same reference characters applied to FIGS. 1 and 2.

Referring to FIG. 4, a solenoid 120 is illustrated including a frame 21, a ferromagnetic armature plunger 22 joined by a connecting rod 23 and a compression spring 27 associated with the solenoid and acting between the armature plunger 22 and the solenoid frame 21.

As with the previously described form of construction, the solenoid 120 includes a permanent magnet 28 chosen so as to neutralize the influence of the spring 27 on the armature. The rod 23 of the solenoid 120 may be connected to thread engaging and severing elements in the same manner as is the solenoid rod 23 in the form shown in FIG. 1.

The solenoid 120 includes two solenoid coils 129 and 229 with leads 130, 131 and 230, 231, respectively.

As shown in the circuit diagram of FIG. 5, the same diode bridge 40, manual control switch 43 and holding circuit 44 therefor, as employed as in the form illustrated in FIGS. 1 and 2, however, no voltage regulator for delivering different levels of voltage are required. A first switch 145 which is a normally open switch and a second switch 146, which is a double pole, normally open switch, are employed and may be arranged in a timing device as illustrated in FIG. 3 in place of the switches 45 and 46, respectively.

When the first switch 145, which is connected between switch 43 and the lead 130 of solenoid 129, is closed by passage of magnet 52 adjacent thereto, since engagement between contact 171 and pole 172 of the switch 146 is open, both solenoid coils 129 and 229 will be energized, leads 131 and 230 being joined and connected to contact 171 of the switch 146 and led 231 being connected to the negative side of the diode bridge 40. The solenoid coils 129 and 229 are constructed and arranged such that when both are engaged they partially counteract one another but do provide a net result substantially completely offsetting the effect of the permanent magnet 28 on the armature 22. As a result, the spring 27 will be freed to shift the armature inwardly and thus to move the thread picker 15 to an extended position as illustrated in dotted lines in FIG. 1.

Preferably the switch 145 is maintained closed until immediately prior to closure of the switch 146 so that the influence of the spring 27 urging the thread picker 15 into extended position as shown in dotted lines in FIG. 1 will be continued. Engagement with the sewing threads may then take place as explained above.

Subsequently, when the magnet 52 passes adjacent to the switch 146, the contacts 161 and 171 will be shifted into engagement with poles 162 and 172, respectively and the switch 145 will be opened. A circuit will thus be established from the positive side of the diode bridge through the contact 161, lead 130, solenoid 129 and lead 131 thereof. The low impedance path around solenoid 229 provided by closure of contact 171 of switch 146 with pole 172 and thus to the negative side of the diode bridge effectively prevents energization of the solenoid 229. The solenid 129 acting alone is arranged to provide an influence on the solenoid armature augmenting that provided by the permanent magnet 28, these magnetic influences together providing for a relatively high force exerted by the armature in opposition to the spring 27 to return the thread picker 15 to the solid line position as illustrated in FIG. 1 thus severing the threads as explained above.

I claim:

1. An underbed thread trimming mechanism for a sewing machine of the type having a movable thread picking element, a thread severing element, means shiftably supporting said thread picking element for movement between a retracted position in effective thread trimming relation with said thread severing element and an extended position suitable for engagement with sewing threads of said sewing machine, the improvement which comprises means for influencing movements of said thread picking element between said retracted and extended positions, said means including an electric solenoid having a frame, a ferromagnetic armature shiftably supported in said frame and operatively connected to said thread picking element, a spring means arranged to act between said armature and sid frame biasing said armature in a direction urging said thread picking element into said extended position, a permanent magnet carried by said solenoid frame and having a magnetic flux generating capacity and position relative to said armature completely to neutralize the influence of said spring means on said armature, solenoid coil means carried by said solenoid frame, first switch means for applying electrical energy to said solenoid coil means effective to substantially cancel the influence of said permanent magnet on said armature and free said spring means to shift said thread picking element into extended position, and second switch means for applying electrical energy to said solenoid coil means effective with said permanent magnet to shift said armature in opposition to said spring means into said retracted position in effective thread trimming relation with said thread severing element.

2. An underbed thread trimming mechanism as set forth in claim 1 including actuating means for said first and second switch means driven in timed relation with said sewing machine for influencing operation of said switch means only at predetermined positions within a stitch forming cycle of a sewing machine.

3. An underbed thread trimming mechanism as set forth in claim 1 in which said solenoid coil means comprises a plurality of separate coils arranged on said solenoid frame each coil effective upon application thereto of electrical energy of uniform magnitude and polarity to exert influence of differing magnitude and direction on said armature, in which said first switch means is effective to apply said electrical energy simultaneously to a plurality of said separate coils, and in which said second switch means is effective to apply said electrical energy to less than the total number of said plurality of separate solenoid coils.

4. An underbed thread trimming mechanism as set forth in claim 3 in which said solenoid coil means comprises two separate coils, in which said first switch means is effective to apply said electrical energy to both of said separate coils simultaneously, and in which said second switch means is effective to apply said electrical energy to only one of said separate solenid coils.

5. An underbed thread trimming mechanism as set forth in claim 1 in which said solenoid coil means comprises a single coil arranged on said solenoid frame, in which two sources of electrical energy of different voltages are provided, and in which said first and second switch means are effective each to apply to said single solenoid coil electrical energy from a different one of said voltage sources.

6. An underbed thread trimming mechanism as set forth in claim 5 in which each of said sources of electrical energy provides a different DC voltage and in which said switch means are connected to said single solenoid coil each so as to apply to said coil electrical energy of a different voltage and polarity.

7. An underbed thread trimming mechanism for a sewing machine of the type having a movable thread picking element, a thread severing element, means shiftably supporting said thread picking element for movement between a retracted position in effective thread trimming relation with said thread severing element and an extended position suitable for engagement with sewing threads of said sewing machine, the improvement which comprises means for influencing movements of said thread picking element between said retracted and extented positions, said means including an electric solenoid having a frame, a ferromagnetic armature shiftably supported in said frame and operatively connected to said thread picking element, spring means arranged to act between said armature and said frame biasing said armature in a direction urging said thread picking element into said extended position, a permanent magnet carried by said solenoid frame and having a magnetic flux generating capacity and position relative to said armature completely to neutralize the influence of said spring means on said armature, a solenoid coil carried by said solenoid frame, means for applying electrical energy of a first magnitude and polarity to said solenoid coil effective to substantially cancel the influence of said permanent magnet freeing the spring means to shift said thread picking element into extended position and means for applying electrical energy of a second magnitude and polarity to said solenoid coil effective to shift said armature in opposition to said spring means into said retracted position in effective thread trimming relation with said thread severing element.

8. An underbed thread trimming mechanism as set forth in claim 7 in which the first magnitude of electrical energy applied to said solenoid coil is approximately one third that of the second magnitude of electrical energy applied thereto.

* * * * *